US009820516B2

(12) United States Patent
Ferrer

(10) Patent No.: US 9,820,516 B2
(45) Date of Patent: Nov. 21, 2017

(54) OPEN-PALM SUN PROTECTIVE GLOVE

(71) Applicant: Patricia Ferrer, Tucson, AZ (US)

(72) Inventor: Patricia Ferrer, Tucson, AZ (US)

(73) Assignee: Patricia Ferrer, Tucson, AZ (US)

( * ) Notice: Subject to any disclaimer, the term of this patent is extended or adjusted under 35 U.S.C. 154(b) by 54 days.

(21) Appl. No.: 15/018,552

(22) Filed: Feb. 8, 2016

(65) Prior Publication Data

US 2016/0235135 A1 Aug. 18, 2016

Related U.S. Application Data

(60) Provisional application No. 62/117,528, filed on Feb. 18, 2015.

(51) Int. Cl.
*A41D 13/08* (2006.01)

(52) U.S. Cl.
CPC ..... *A41D 13/084* (2013.01); *A41D 2400/26* (2013.01)

(58) Field of Classification Search
CPC ..... A41D 2400/46; A41D 13/084; A41D 2300/50
USPC ..... 2/16, 161.2, 275
See application file for complete search history.

(56) References Cited

U.S. PATENT DOCUMENTS 632,547 A * 9/1899 Barth ..... A41D 19/01 2/158
1,915,617 A * 6/1933 Potter ..... A63B 71/146 2/161.2
D229,253 S * 11/1973 Angelo ..... D29/113
D267,129 S * 12/1982 Kneisley ..... D29/113
4,785,478 A * 11/1988 Mosley ..... A41D 13/084 2/161.6
4,809,366 A * 3/1989 Pratt ..... A41D 20/00 2/161.2
4,967,419 A * 11/1990 Elliott ..... A41D 13/08 2/16
5,070,541 A * 12/1991 Goss ..... A41D 13/08 2/16
5,125,115 A * 6/1992 Lincoln ..... A41D 13/084 2/159
5,357,633 A * 10/1994 Rael ..... A41D 13/08 2/126
5,402,536 A * 4/1995 Matthews ..... A41D 13/08 2/16
5,435,012 A * 7/1995 Lincoln ..... A41D 13/084 2/159

(Continued)

*Primary Examiner* — Ruth Ilan

(57) ABSTRACT

The invention is an open-palm sun protective glove that covers the back of the hand protecting it from solar ultraviolet radiation. It allows the palm to maintain mobility, dexterity, tactility, sensitivity, and to release heat and maintain coolness. This open-palm glove has three sheaths that anchor it on the hand: thumb, 5$^{th}$ digit, and wrist. This allows the glove to fit comfortably and slip on and off easily. It is made from textile industry tested ultraviolet protective factor fabric made of knit, woven, or other textile fabric allowing the glove to fit snuggly on the hand. This invention protects the back of the hands, of the wearer, from chronic and intense sun exposure that can cause pre-cancers, skin cancers and sun damage while allowing natural sense of touch and palm-side heat dissipation.

5 Claims, 4 Drawing Sheets

(56) References Cited

U.S. PATENT DOCUMENTS

| | | | | | |
|---|---|---|---|---|---|
| 5,628,062 | A * | 5/1997 | Tseng | A41D 13/08 | 2/16 |
| 6,418,563 | B1 * | 7/2002 | Turner | A41B 11/00 | 2/16 |
| 6,539,550 | B1 * | 4/2003 | Flores | A41D 13/08 | 2/159 |
| 6,748,599 | B1 * | 6/2004 | Farady | A41D 13/084 | 2/16 |
| D502,573 | S * | 3/2005 | Jones | D29/113 | |
| 6,952,838 | B1 * | 10/2005 | Gillette | A41D 15/002 | 2/159 |
| RE38,948 | E * | 1/2006 | Redman | 2/159 | |
| D675,381 | S * | 1/2013 | Rambo | D29/100 | |
| D715,496 | S * | 10/2014 | Hain | D29/117.1 | |
| D779,783 | S * | 2/2017 | Dong | D2/622 | |
| 2012/0137401 | A1 * | 6/2012 | Ramirez | A63B 71/141 | 2/161.1 |
| 2013/0198920 | A1 * | 8/2013 | Wittman | A63B 71/141 | 2/16 |
| 2014/0318564 | A1 * | 10/2014 | Teital | A45D 29/00 | 132/73 |
| 2015/0103400 | A1 * | 4/2015 | Porooshani | A41D 19/015 | 359/361 |
| 2015/0143600 | A1 * | 5/2015 | House | A63B 71/141 | 2/20 |
| 2015/0201681 | A1 * | 7/2015 | Ron | A41D 13/002 | 2/84 |
| 2015/0296903 | A1 * | 10/2015 | Hamasaki, Jr. | A41D 19/015 | 2/16 |
| 2015/0309219 | A1 * | 10/2015 | Butz | G02B 5/0891 | 359/361 |

* cited by examiner

OPEN-PALM SUN PROTECTIVE GLOVE

REFERENCES CITED

U.S. Patent Documents

| | | | |
|---|---|---|---|
| US 2015/0103400 | April 2015 | Porooshani | A42D 19/015 |
| U.S. Pat. No. 5,357,633 | October 1994 | Rael | 2/16; 2/59; 2/126 |
| U.S. Pat. No. 6,952,838 | October 2005 | Gillette | 2/159; 2/160 |
| U.S. Pat. No. 5,628,062 | May 1997 | Tseng | 2/16; 2/59 |
| U.S. Pat. No. 4,785,478 | November 1988 | Mosley | 2/161 R |
| U.S. Pat. No. 6,539,550 B1 | April 2003 | Flores | 2/16; 2/159 |
| U.S. Pat. No. 5,435,012 | July 1995 | Lincoln | 2/159 |
| U.S. Pat. No. 6,748,599 B1 | June 2004 | Farady | 2/16 |
| U.S. Pat. No. 5,125,115 | June 1992 | Lincoln | 2/159 |
| U.S. Pat. No. 4,967,419 | November 1990 | Elliot | 2/16 |
| U.S. Pat. No. 4,809,366 | May 1989 | Pratt | 2/170 |

BACKGROUND

Field of Invention

This invention is an open-palm, fingerless, sun protective glove, made of textile industry tested sun protective Ultraviolet Protective Factor (UPF) fabric to protect the dorsal side of the users' hands (known as the back of hand) from ultraviolet radiation (UVR) sun exposure, maintain palmar sensitivity and allow heat dissipation.

The number of skin cancers is on the rise as the population ages and with the cumulative affects of sun exposure one's risk increases. The areas on the body most commonly uncovered and exposed to solar UVR are the face, hands, and arms and these bear the brunt of precancerous and cancerous skin lesions. These cumulative effects and ongoing sun exposure can lead to pre-cancers (known as actinic keratoses), skin cancers (basal cell carcinoma, squamous cell carcinoma, and melanoma) and photo-damage in the Caucasian population that work outdoors or participate in outdoor activities. Treating pre-cancers and skin cancers have a high burden of cost on the healthcare system and causes significant morbidity, cost, cosmetic disfigurement, and inconvenience for the patient.

Many sun protective gloves have been invented in the past as shown by prior art, in cited references, however they are not easy to put on and the palm-side attachment portion interferes with the wearer's ability to handle and hold on to tools or outdoor sporting equipment (racket sports or golf club) that requires palm-side tactility and natural evaporation and cooling as provided by release of heat from the palm. The prior art, in cited references, also demonstrates palm-less gloves but the attachments are in critical areas of tactility, i.e., finger tips, loop around the base of the fingers, or have a buckle, snap or Velcro around the volar wrist adding bulk to the glove. If one were to use traditional gloves for sun protection it would compromise their performance of their respective racket sport and could endanger the worker who used tools in which dexterity and tactility is necessary. In addition, application of sunscreen to the dorsal hand tends to be oily, greasy or creamy which migrates to the palm of the hand causing slippage of handheld tools or sporting implements. Sunscreens also do not provide the maximal sun protection as well as a physical barrier of UPF fabric.

The present invention is a moderately form fitting sun protective glove that covers the dorsal side of the hand leaving the fingers free and leaving more than 90% of the palm-side exposed. This helps to maintain sensitivity and tactility, maximize dexterity, allow natural release of palmar-side hand heat and protects the dorsal side of the hand from excessive sun exposure that can lead to untoward effects such as pre-cancers, skin cancers and photo-damage. This sun protective glove is made from textile industry tested fabric and is determined to be ultraviolet protective and is designated as UPF fabric. This invention is made from of knit and/or woven fabric and/or other textile material and/or the combination thereof. Because of the advancement of UPF fabrics, this glove is simplified, light and is easy to put on and take off and care for.

BRIEF SUMMARY OF THE INVENTION

This invention is a sun protective open-palm and fingerless glove that uses the physical protection properties of UPF fabric to protect the dorsal aspect of the hand for users that are exposed to solar UVR. The variety of fabric used for this invention is tested by guidelines set by the American Society for Testing and Materials, known as the ASTM, or the American Association of Textile Chemist and Colorist, known as the AATCC. These independent laboratories determine how much of UVR penetrates through fabric to the skin, thus giving a rating of UPF 15, 30, 45, 50 (meaning $1/15^{th}$, $1/30^{th}$, $1/45^{th}$, $1/50^{th}$ of UVR penetration, respectively). The glove has a dorsal side, inner side, thumb sheath and $5^{th}$ digit sheath and a wrist sheath that allows the glove to fit snuggly and securely to the hand for maximum comfort. The sheaths are open-ended allowing the thumb and $5^{th}$ digit fingertips to be uncovered. The dorsal side of the glove covers the back of the hand, leaving the majority of fingers uncovered and free for movement allowing the user to maintain their finger and palmar side sensitivity, tactility, mobility and use, and allow palmar heat dissipation. The inner portion of the dorsal side rests snuggly directly on the dorsal hand. The wrist sheath encloses the dorsal and volar wrist. To put the glove on, the hand slips through the proximal opening of the wrist sheath, the thumb slips through the respective thumb sheath and the $5^{th}$ digit (pinky finger) slips through the $5^{th}$ digit sheath, all anchoring the glove to the hand. There are no buckles, snaps, or Velcro as shown in prior art. This sun protective glove invention allows the user ease of the putting the glove on and taking the glove off.

The best use of this invention is to protect the dorsal hand from solar UVR for the outdoor worker and outdoor enthusiast, be it sports or other hobby. This invention can also have the wrist sheath extended to cover the forearms and up to the upper arm, like a sleeve, providing even more sun protective benefits on sun exposed areas.

REFERENCE NUMERALS IN THE DRAWINGS

| | |
|---|---|
| 1 dorsal hand cover | 16 distal opening of wrist sheath |
| 2 dorsal wrist sheath | 17 palmar thenar side |
| 3 proximal wrist sheath | 18 palmar thumb sheath |
| 4 distal dorsal hand cover | 19 palmar hypothenar side |
| 5 dorsal $5^{th}$ digit sheath | 20 palmar $5^{th}$ digit sheath |
| 6 dorsal thumb sheath | 21 palmar side $5^{th}$ digit sheath attachment seam |
| 7 dorsal thenar side | 22 palmar side thumb sheath attachment scam |
| 8 dorsal radial wrist sheath side | 23 user's thumb |
| 9 dorsal ulnar wrist sheath side | 24 user's $2^{nd}$ digit of hand |
| 10 dorsal hypothenar side | 25 user's $3^{rd}$ digit of hand |
| 11 inner side of dorsal hand cover | 26 user's $4^{th}$ digit of hand |
| 12 distal volar wrist sheath | 27 user's $5^{th}$ digit of hand |
| 13 volar wrist sheath | 28 user' forearm |
| 14 volar wrist sheath seam | 32 hypothenar eminence |
| 15 proximal opening of wrist sheath | 33 thenar eminence |
| 29 user's palm of hand | |
| 30 pads of the distal palm | |
| 31 base of the palm | |

DETAILED DESCRIPTION AND BEST MODE OF IMPLEMENTATION

Figure 1:
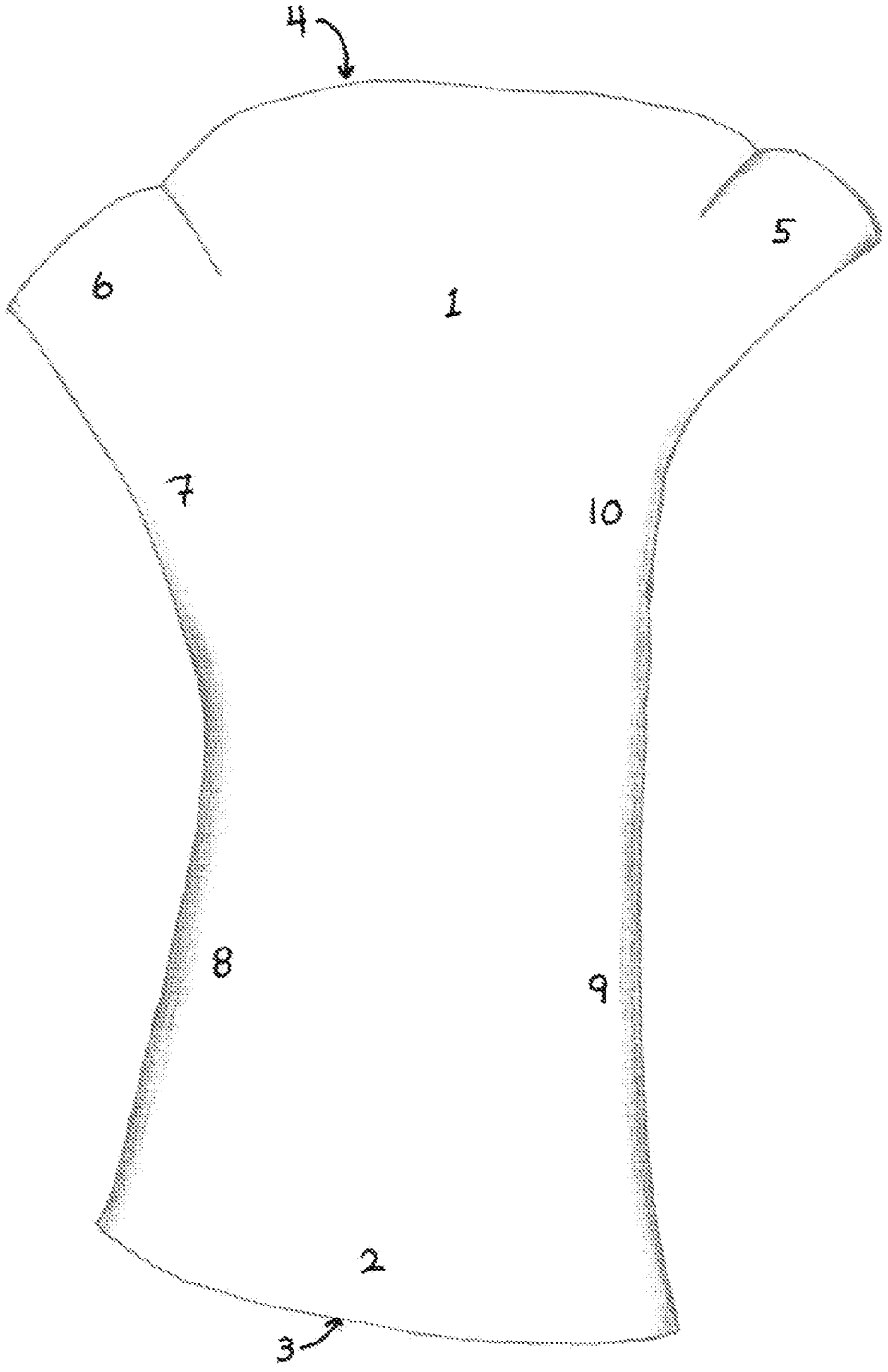
FIG. 1 is a perspective view of the dorsal side of the present invention.

FIG. 1 shows a perspective view of the dorsal side of the present invention not being worn on the right hand of the user. This invention has a dorsal hand cover 1 that lays snuggly over the dorsal aspect of the hand. The user puts on the invention by slipping their hand through the dorsal wrist sheath 2 at its proximal wrist sheath 3. The invention is anchored in place by slipping the $5^{th}$ digit of the hand through the dorsal $5^{th}$ digit sheath 5 and slipping the thumb through the dorsal thumb sheath 6 and overall the invention is held in place by the dorsal wrist sheath 2.

Figure 2:
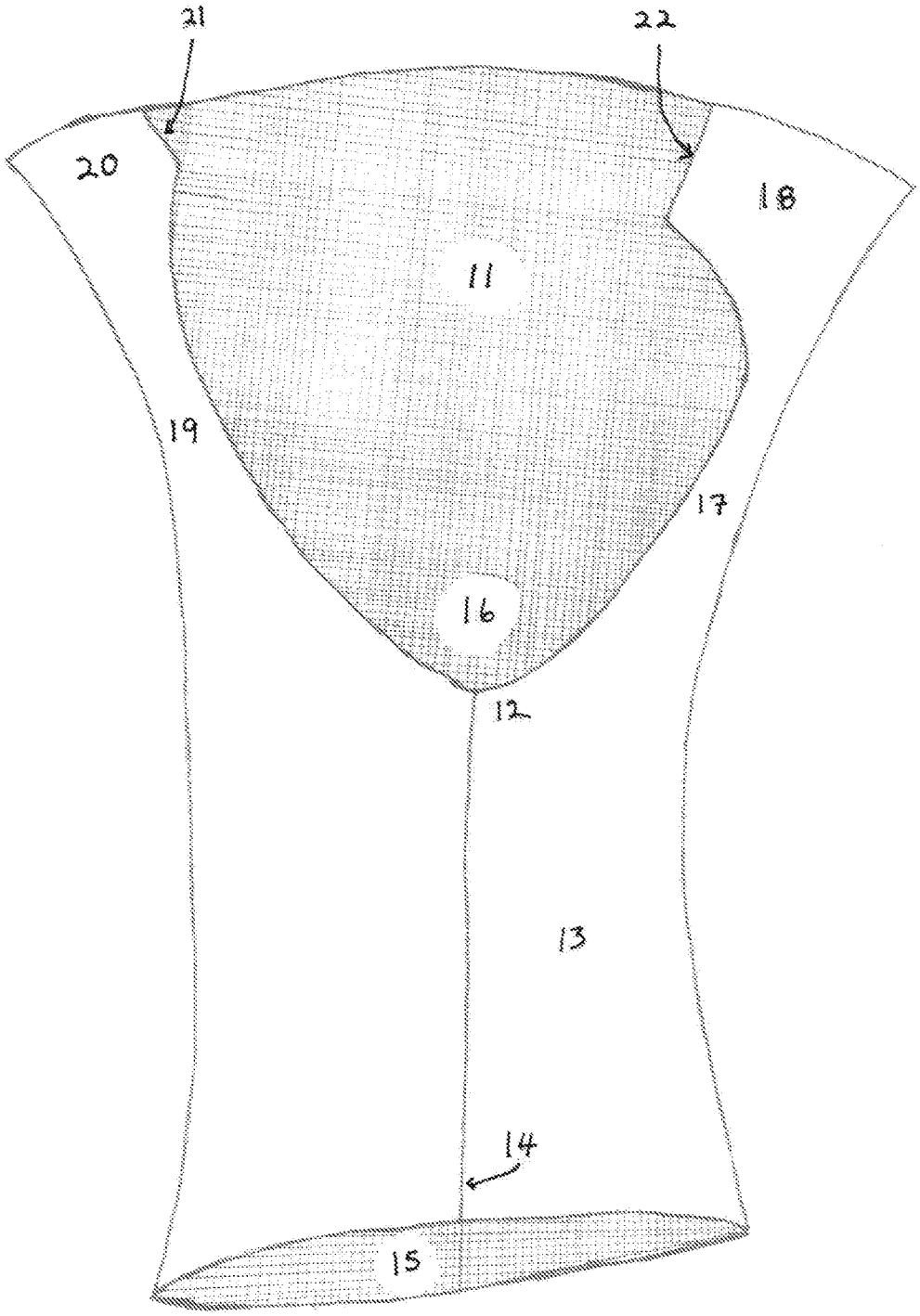
FIG. 2 is a perspective view of the volar, palmar and inner side of the present invention.

The distal dorsal hand cover 4 and the dorsal hand cover 1, rest lightly or snuggly over the proximal fingers as it is held in place by the dorsal $5^{th}$ digit sheath 5 and the dorsal thumb sheath 6 which are sewn to the inner side of the dorsal hand cover 11 (shown in FIG. 2). The dorsal thenar side 7 and the dorsal radial wrist sheath side 8 cover the radial side of the hand, wrist and distal forearm. The dorsal hypothenar side 10 and dorsal ulnar wrist sheath side 9 cover the ulnar side of the hand, wrist and distal forearm.

FIG. 2 is a perspective view of the volar, palmar and inner side of the present invention not being worn by the hand of the user. When worn by the user, the inner side of the dorsal hand cover 11 will rest snuggly on the dorsal hand. The distal volar wrist sheath 12 has an arcuated curve allowing the base of the palm 31 (shown in FIG. 4) to remain uncovered. The volar wrist sheath 13 and dorsal wrist sheath 2 (shown digit 27 are exposed and non-encumbered. The user's forearm 28 extends out of the proximal opening of the wrist sheath 15.

Figure 4:
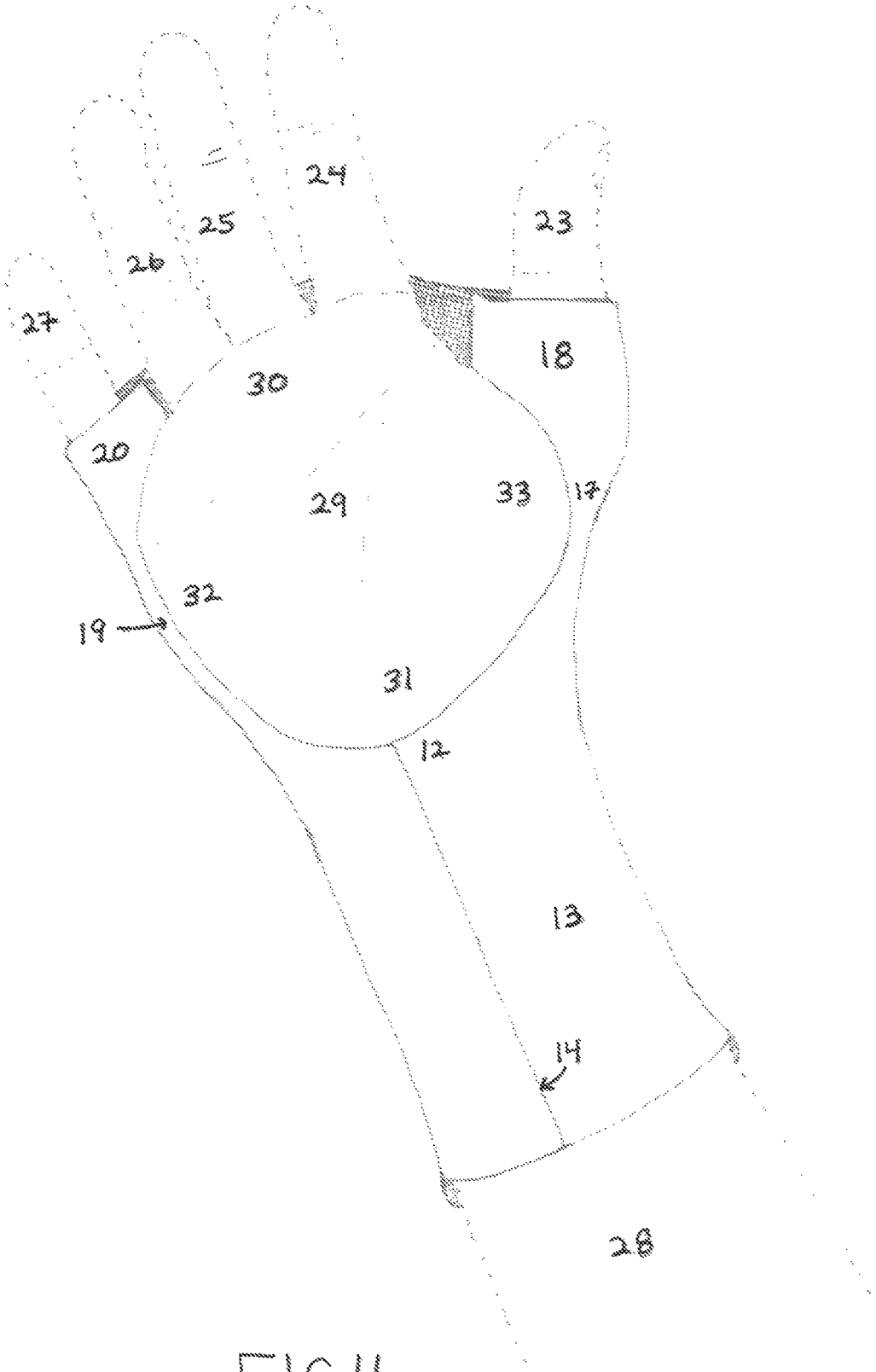
FIG. 4 is a perspective view of the palmar and volar side of the present invention as worn on the hand of the user.

FIG. 4 is a perspective view of the palmar and volar side of the present invention as worn on the hand of the user. This view shows the observer how the majority of the palm is left open. The hypothenar eminence 32 and the thenar eminence 33 are uncovered and have the ability to hold a sports implement, such as a tennis racket, golf club, or fishing rod as well as a tool such as a hammer, hand saw, or wrench, etc. The finger pads of the distal palm 30 are also uncovered as are the $2^{nd}$ digit 24, $3^{rd}$ digit 25, and $4^{th}$ digit 26. The distal phalanx of the thumb 23 and the middle and distal phalanges of the $5^{th}$ digit 27 are also uncovered. The distal volar wrist sheath 12 abuts to the outside of the base of the palm 31 covering the volar wrist and allowing the base of the palm 31 to be uncovered.

The main purpose of this invention is to protect the back of the hand of the user from solar UVR. The material used is a knit and/or woven fabric and/or other textile material, which is tested independently from the fabric and or garment manufacture and is determined to provide Ultraviolet Protected Factor rating. The American Society for Testing and Materials and the American Association of Textile Chemists and Colorist has set the standard in testing fabrics to determine that the fabric offers a certain amount of UPF. There are numerous testing laboratories that adequately perform these tests and determine the amount of UPF offered by certain fabrics. UPF 30 fabric equates to $1/30^{th}$ of the sun's UVR to pass through the fabric or better understood as 96-97.4% of UVR blocked; UPF 45 equates to $1/45^{th}$ of the sun's UVR to pass through the fabric or better understood as 97.5% of UVR blocked and UPF 50 equates to $1/50^{th}$ of the sun's UVR to pass through the fabric or better understood as 97.5-98% of UVR blocked from reaching the skin if worn properly. Providing sun protective gloves requires using UPF sun protective fabric of varying fiber types, weaves and or knits, and various finishes to maximize comfort, performance and efficacy of the user's activities. Therefore the fabric could be a combination of nylon, polyester, spandex, fleece, cotton, rayon, wool, silk, flax or any combination of natural, synthetic or recycled textile product. With textile technological advancements, fabric fiber can be blended and treated to maximize their UPF abilities. The thread to be used can also include the aforementioned combinations and/or cotton, polyester, nylon or spandex.

The invention is made of one piece of fabric cut in a certain pattern and assembled with three seams to yield an open-palm sun protective glove. The features are the dorsal hand portion, the wrist sheath portion, the anchoring thumb and $5^{th}$ digit sheaths, and the inner side of the dorsal hand portion. The seams of the invention include the volar wrist seam, which creates the wrist sheath, the thumb and index finger web-space seam, which is attached to the inner side of the dorsal hand portion, the web-space seam between the 4th, and $5^{th}$ digit which creates the $5^{th}$ digit sheath.

The invention can be made from various stretch, woven and other textile fabrics. Textile technology is advancing and more options for fabric to be used will be available in the future. This invention has three utilities: 1) to cover the back of the hand protecting it from UVR sun damage, pre-cancers and skin cancers for the outdoor worker or outdoor athlete and enthusiast; 2) with the palm open it allows palmar tactility, mobility, and sensitivity; and 3) with the palm uncovered, heat can escape and keep the palm cool. The thumb sheath, $5^{th}$ digit sheath and wrist sheath are the anchoring portions in FIG. 1) encompass the volar wrist and distal forearm as it is sewn together for closure at the volar wrist sheath seam 14. The entry space for the hand into this invention is at the proximal opening of the wrist sheath 15 and exits through the end of distal opening of the wrist sheath 16. The palmar thenar side 17 will cover the lateral thenar eminence as the thumb slips through the palmar thumb sheath 18 and the palmar hypothenar side 19 will cover the lateral side of the hypothenar eminence as the $5^{th}$ digit slips into the palmar $5^{th}$ digit sheath 20.

The sheaths of the present invention are key to this unique open-palm sun protective glove. The volar wrist sheath seam 14 joins the dorsal wrist sheath 2 and the volar wrist sheath 13 on the volar side of the invention. The palmar $5^{th}$ digit sheath 20 is attached by the palmar side of the $5^{th}$ digit sheath attachment seam 21 to the inner side of the dorsal hand cover 11. The palmar thumb sheath 18 is attached by the palmar side of the thumb sheath attachment seam 22 to the inner side of the dorsal hand cover 11. These three sheaths properly anchor the glove to the hand, which covers the dorsal hand snuggly and comfortably with UPF fabric. The sheaths cover the proximal thumb and $5^{th}$ digit of the hand in which this is the only palmar side of the hand that is covered, leaving the distal thumb and $5^{th}$ digit exposed.

Figure 3:
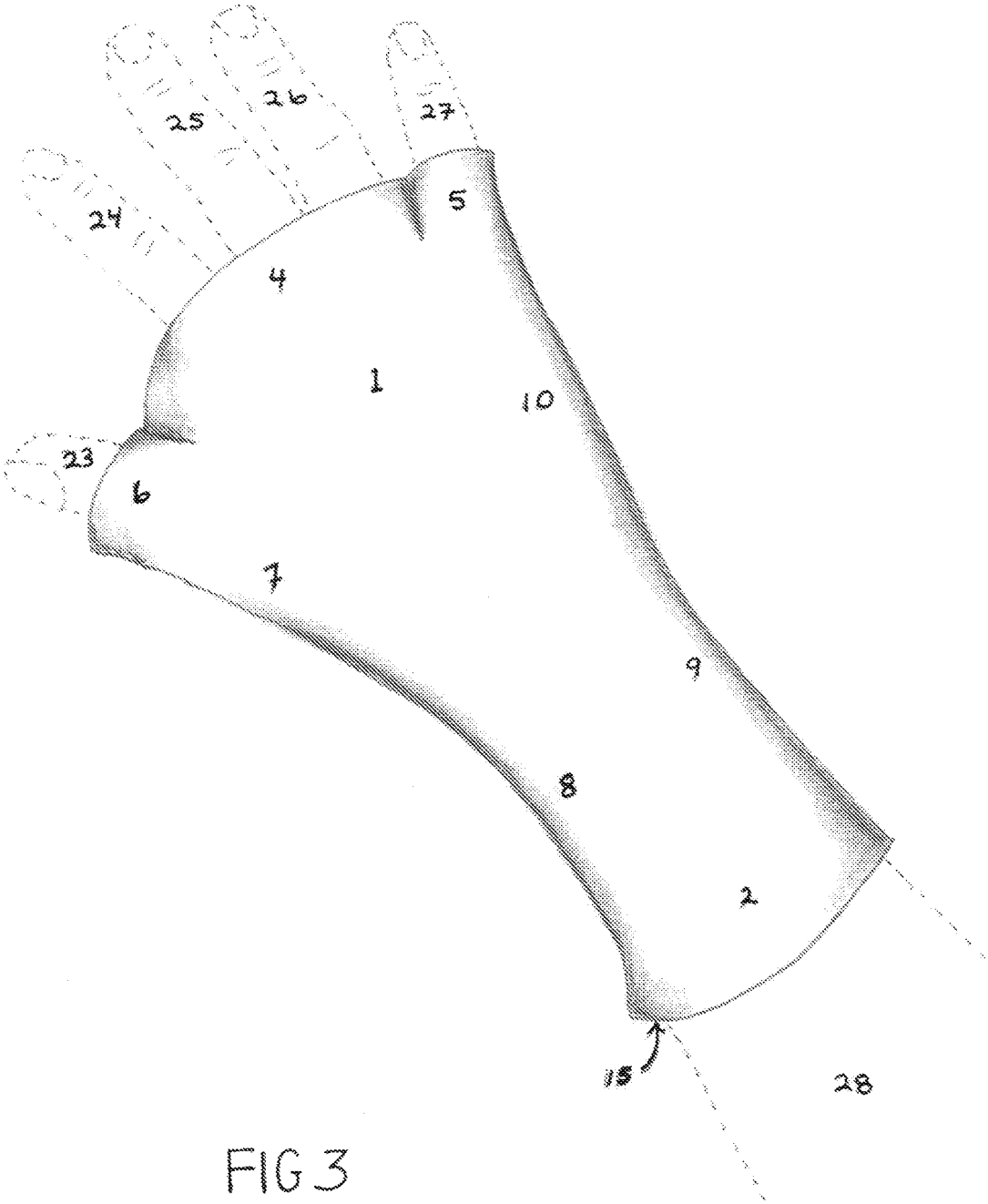
FIG. 3 is a perspective view of the dorsal side of the present invention as worn on the hand of the user.

FIG. 3 is a perspective view of the dorsal side of the present invention as worn on the hand of the user. This view of the glove shows how the glove fits on the hand of the user protecting the dorsal side of the hand. The dorsal hand cover 1 lies on the dorsal hand, the dorsal wrist sheath 2 anchors the glove, and the dorsal thumb sheath 6 and the dorsal $5^{th}$ digit sheath 5 anchor the distal portion of the glove. The majority of the user's thumb 23, user's $2^{nd}$ digit 24, user's $3^{rd}$ digit 25, user's $4^{th}$ digit 26, user's $5^{th}$ of this invention that yield the glove to have an open palm. The wrist sheath can be extended proximally toward the elbow to cover the forearm and can also extend all the way up the upper arm creating a sleeve to protecting the forearm and upper arm but maintaining the glove design over the hand with the open palm.

I claim:

1. An open-palm and fingerless sun protective glove made from one piece of sun protective fabric to be worn on a hand of a user so as to cover the back of the hand comprising:

a dorsal hand portion having an inner side, a wrist sheath portion, an anchoring thumb sheath and a $5^{th}$ digit sheath, wherein the glove is adapted to be anchored to the hand of the user by the wrist sheath portion, the anchoring thumb sheath and the $5^{th}$ digit sheath;

further comprising three seams including a volar wrist seam which creates the wrist sheath portion, a thumb and index finger interdigital web-space seam attached to the inner side of the dorsal hand portion so as to create the thumb sheath, and a $4^{th}$ and $5^{th}$ interdigital web-space seam attached to the inner side of the dorsal hand portion so as to create the $5^{th}$ digit sheath; and wherein the glove is configured so that while worn on the hand of the user, the glove is adapted to keep the palm and the entire of the $2^{nd}$, $3^{rd}$, and $4^{th}$ palmar side digits uncovered and exposed allowing natural palmar tactility, dexterity, and sensitivity of the hand.

2. The open-palm and fingerless sun protective glove of claim 1, wherein the one piece of sun protective fabric is knit or woven ultraviolet protection fabric.

3. The open-palm and fingerless sun protective glove of claim 1, wherein the glove is adapted to allow more than 90% of the palmar side of the hand to be uncovered.

4. The open-palm and fingerless sun protective glove of claim 1, wherein when worn, the wrist sheath is adapted to extend up to the forearms of the user.

5. The open-palm and fingerless sun protective glove of claim 1, wherein when worn, the wrist sheath is adapted to extend beyond the elbow of the user.

* * * * *